US005323143A

United States Patent [19]

Naradate et al.

[11] Patent Number: 5,323,143

[45] Date of Patent: Jun. 21, 1994

[54] LIQUID CRYSTAL PANEL AND LIQUID CRYSTAL DISPLAY DEVICE

[75] Inventors: Koji Naradate; Kazuhisa Takazawa, both of Tokyo, Japan

[73] Assignee: Seiko Instruments Inc., Japan

[21] Appl. No.: 24,406

[22] Filed: Mar. 1, 1993

[30] Foreign Application Priority Data

Mar. 18, 1992 [JP] Japan ..... 4-062117

[51] Int. Cl.[5] ..... G09G 3/04

[52] U.S. Cl. ..... 345/99; 345/50

[58] Field of Search ..... 340/756, 765

[56] References Cited

U.S. PATENT DOCUMENTS

| | | | |
|---|---|---|---|
| 4,323,893 | 4/1982 | Ypsilantis et al. | 340/756 |
| 4,647,924 | 3/1987 | Naqib | 340/756 |
| 4,794,390 | 12/1988 | Lippman | 340/756 |
| 4,949,081 | 8/1990 | Keller et al. | 340/756 |

FOREIGN PATENT DOCUMENTS

| | | | |
|---|---|---|---|
| 2071386 | 9/1981 | United Kingdom | 340/756 |

*Primary Examiner*—Ulysses Weldon

*Assistant Examiner*—Gin Goon

*Attorney, Agent, or Firm*—Bruce L. Adams; Van C. Wilks

[57] ABSTRACT

A liquid crystal panel, and a device and a method using the panel for displaying alphanumeric characters. The inventive liquid crystal panel has a structure that groups of display segments are arranged as display units; each of the groups including twenty-two display segments: four segments located in four corners of a rough quadrilateral, two oblong segments located on a left side area of the quadrilateral, two oblong segments located in a right side area of the quadrilateral, three segments located on a lower side area of the quadrilateral, nine segments in three columns in three rows located inside of the quadrilateral outlined by the above thirteen segments, and two segments located on an upper side area of the quadrilateral and having a width larger than those of the above nine segments inside the quadrilateral. In the inventive liquid crystal panel, a predetermined character data is displayed by actuating predetermined segments among the twenty-two segments on the panel.

5 Claims, 15 Drawing Sheets

FIG. 7

| | COM1 | COM2 | COM3 | COM4 | COM5 | COM6 | COM7 | COM8 | COM9 |
|---|---|---|---|---|---|---|---|---|---|
| C1 | COM1 | | | | | | | | |
| C2 | | COM2 | | | | | | | |
| C3 | | | COM3 | | | | | | |
| C4 | | | | COM4 | | | | | |
| C5 | | | | | COM5 | | | | |
| C6 | | | | | | COM6 | | | |
| C7 | | | | | | | COM7 | | |
| C8 | | | | | | | | COM8 | |
| C9 | | | | | | | | | COM9 |
| S1 | 12c | 24v | 24q | 24i | 24d | 12v | 12q | 12i | 12d |
| S2 | 24u | 24p | 24l | 24h | 24c | 12u | 12p | 12l | 12h |
| S3 | M6 | 24t | 24o | 24k | 24g | 12t | 12o | 12k | 12g |
| S4 | 24s | 24n | 24j | 24f | 24b | 12s | 12n | 12j | 12f |
| S5 | 12b | 24r | 24m | 24e | 24a | 12r | 12m | 12e | 12a |
| S6 | 11c | 23v | 23q | 23i | 23d | 11v | 11q | 11i | 11d |
| S7 | 23u | 23p | 23l | 23h | 23c | 11u | 11p | 11l | 11h |
| S8 | M5 | 23t | 23o | 23k | 23g | 11t | 11o | 11k | 11g |
| S9 | 23s | 23n | 23j | 23f | 23b | 11s | 11n | 11j | 11f |

FIG. 8

| | COM1 | COM2 | COM3 | COM4 | COM5 | COM6 | COM7 | COM8 | COM9 |
|---|---|---|---|---|---|---|---|---|---|
| S10 | 11b | 23r | 23m | 23e | 23a | 11r | 11m | 11e | 11a |
| S11 | 10c | 22v | 22q | 22i | 22d | 10v | 10q | 10i | 10d |
| S12 | 22u | 22p | 22l | 22h | 22c | 10u | 10p | 10l | 10h |
| S13 | | 22t | 22o | 22k | 22g | 10t | 10o | 10k | 10g |
| S14 | 22s | 22n | 22j | 22f | 22b | 10s | 10n | 10j | 10f |
| S15 | 10b | 22r | 22m | 22e | 22a | 10r | 10m | 10e | 10a |
| S16 | 9c | 21v | 21q | 21i | 21d | 9v | 9q | 9i | 9d |
| S17 | 21u | 21p | 21l | 21h | 21c | 9u | 9p | 9l | 9h |
| S18 | | 21t | 21o | 21k | 21g | 9t | 9o | 9k | 9g |
| S19 | 21s | 21n | 21j | 21f | 21b | 9s | 9n | 9j | 9f |
| S20 | 9b | 21r | 21m | 21e | 21a | 9r | 9m | 9e | 9a |
| S21 | 8c | 20v | 20q | 20i | 20d | 8v | 8q | 8i | 8d |
| S22 | 20u | 20p | 20l | 20h | 20c | 8u | 8p | 8l | 8h |
| S23 | | 20t | 20o | 20k | 20g | 8t | 8o | 8k | 8g |
| S24 | 20s | 20n | 20j | 20f | 20b | 8s | 8n | 8j | 8f |
| S25 | 8b | 20r | 20m | 20e | 20a | 8r | 8m | 8e | 8a |
| S26 | 7c | 19v | 19q | 19i | 19d | 7v | 7q | 7i | 7d |

FIG. 9

| | COM1 | COM2 | COM3 | COM4 | COM5 | COM6 | COM7 | COM8 | COM9 |
|---|---|---|---|---|---|---|---|---|---|
| S27 | 19u | 19p | 19l | 19h | 19c | 7u | 7p | 7l | 7h |
| S28 | M4 | 19t | 19o | 19k | 19g | 7t | 7o | 7k | 7g |
| S29 | 19s | 19n | 19j | 19f | 19b | 7s | 7n | 7j | 7f |
| S30 | 7b | 19r | 19m | 19e | 19a | 7r | 7m | 7e | 7a |
| S31 | 6c | 18v | 18q | 18i | 18d | 6v | 6q | 6i | 6d |
| S32 | 18u | 18p | 18l | 18h | 18c | 6u | 6p | 6l | 6h |
| S33 | | 18t | 18o | 18k | 18g | 6t | 6o | 6k | 6g |
| S34 | 18s | 18n | 18j | 18f | 18b | 6s | 6n | 6j | 6f |
| S35 | 6b | 18r | 18m | 18e | 18a | 6r | 6m | 6e | 6a |
| S36 | 5c | 17v | 17q | 17i | 17d | 5v | 5q | 5i | 5d |
| S37 | 17u | 17p | 17l | 17h | 17c | 5u | 5p | 5l | 5h |
| S38 | M3 | 17t | 17o | 17k | 17g | 5t | 5o | 5k | 5g |
| S39 | 17s | 17n | 17j | 17f | 17b | 5s | 5n | 5j | 5f |
| S40 | 5b | 17r | 17m | 17e | 17a | 5r | 5m | 5e | 5a |
| S41 | 4c | 16v | 16q | 16i | 16d | 4v | 4q | 4i | 4d |
| S42 | 16u | 16p | 16l | 16h | 16c | 4u | 4p | 4l | 4h |
| S43 | | 16t | 16o | 16k | 16g | 4t | 4o | 4k | 4g |

FIG. 10

| | COM1 | COM2 | COM3 | COM4 | COM5 | COM6 | COM7 | COM8 | COM9 |
|---|---|---|---|---|---|---|---|---|---|
| S44 | 16s | 16n | 16j | 16f | 16b | 4s | 4n | 4j | 4f |
| S45 | 4b | 16r | 16m | 16e | 16a | 4r | 4m | 4e | 4a |
| S46 | 3c | 15v | 15q | 15i | 15d | 3v | 3q | 3i | 3d |
| S47 | 15u | 15p | 15l | 15h | 15c | 3u | 3p | 3l | 3h |
| S48 | M2 | 15t | 15o | 15k | 15g | 3t | 3o | 3k | 3g |
| S49 | 15s | 15n | 15j | 15f | 15b | 3s | 3n | 3j | 3f |
| S50 | 3b | 15r | 15m | 15e | 15a | 3r | 3m | 3e | 3a |
| S51 | 2c | 14v | 14q | 14i | 14d | 2v | 2q | 2i | 2d |
| S52 | 14u | 14p | 14l | 14h | 14c | 2u | 2p | 2l | 2h |
| S53 | | 14t | 14o | 14k | 14g | 2t | 2o | 2k | 2g |
| S54 | 14s | 14n | 14j | 14f | 14b | 2s | 2n | 2j | 2f |
| S55 | 2b | 14r | 14m | 14e | 14a | 2r | 2m | 2e | 2a |
| S56 | 1c | 13v | 13q | 13i | 13d | 1v | 1q | 1i | 1d |
| S57 | 13u | 13p | 13l | 13h | 13c | 1u | 1p | 1l | 1h |
| S58 | M1 | 13t | 13o | 13k | 13g | 1t | 1o | 1k | 1g |
| S59 | 13s | 13n | 13j | 13f | 13b | 1s | 1n | 1j | 1f |
| S60 | 1b | 13r | 13m | 13e | 13a | 1r | 1m | 1e | 1a |

LIQUID CRYSTAL PANEL AND LIQUID CRYSTAL DISPLAY DEVICE

BACKGROUND OF THE INVENTION

The present invention is related to a liquid crystal panel, and a device and a method using the panel for displaying alphanumeric characters.

Conventionally, well-known methods for displaying alphanumeric characters are display by dot matrices or display using a liquid crystal panel. In the latter, a segment in a predetermined position is lighted among a pattern, a so-called "British flag," which is composed by putting an alphabetic character "X" on chinese character "⊞" that is pronounced "ta" or "den". Such devices are disclosed in Japanese Patent Provisional Publications No. JP-A-147070/1979 and No. JP-A-104196/1978, and Japanese Utility Model Provisional Publications No. JP-A-U35562/1980 No. JP-A-U55877/1981 and so on.

However, the conventional liquid crystal panels require fine patterns in order to display legible characters. For the purpose of making characters legible, it is necessary to provide very fine patterns on a display panel, and therefore to connect many drive signal generating circuits to the panel. Consequently, it takes many steps to manufacture a display panel and a display device. For example, the display by dot matrices. On the other hand, if simplified patterns are used for display in order to decrease the number of manufacturing steps, displayed alphanumeric characters become illegible. For instance, display with a British flag. Therefore, there is a desire that more legible alphanumeric characters would be displayed with a liquid crystal panel composed of a small number of segments.

SUMMARY OF THE INVENTION

An object of the present invention is to obtain a liquid crystal panel, and a display device and a display method which can display legibly alphanumeric characters with a few segments in order to solve such a conventional problem.

To solve the above problem, in the present invention a liquid crystal panel has a structure that groups of twenty-two segments are arranged as display units in order to obtain a liquid crystal panel capable of displaying legibly alphanumeric characters with a few segments. Each of the segment groups comprises: —four segments located in four corners of a rough quadrilateral, two segments in an oblong shape located on a left side area of the quadrilateral, two segments in an oblong shape located on a right side area of it, three segments located in a lower side area of it, nine segments in three columns in three rows located inside of the quadrilateral outlined by the above eleven segments, and two segments located in an upper side area and having a width wider than those of the above nine segments inside the quadrilateral.

A character memory circuit memorizes a character configuration which indicates a predetermine character data by actuating predetermined segments among twenty-two segments of a liquid crystal panel. A display signal generating circuit receives display timing and a data to be displayed from a display control circuit, and according to the display timing converts the data to be displayed into an actuating signal with the character memory circuit. A first drive signal generating circuit receives the actuating signal from the display signal generating circuit, and generates a signal for driving a first panel of the liquid crystal panel in order to display the predetermined character data. A second drive signal generating circuit receives the actuating signal from the display signal generating circuit, and generates a signal for driving a second panel of the liquid crystal panel in order to display the predetermined character data. The liquid crystal panel display the predetermined character data according to the first and second driving signals.

BRIEF DESCRIPTION OF THE DRAWINGS

FIG. 7 is an assignment table assigning operation that a predetermined character data is displayed by actuating predetermined segments among the twenty-two segments of the inventive liquid crystal panel.

FIG. 8 is an assignment table assigning operation that a predetermined character data is displayed by actuating predetermined segments among the twenty-two segments of the inventive liquid crystal panel.

FIG. 9 is an assignment table assigning operation that a predetermined character data is displayed by actuating predetermined segments among the twenty-two segments of the inventive liquid crystal panel.

FIG. 10 is an assignment table assigning operation that a predetermined character data is displayed by actuating predetermined segments among the twenty-two segments of the inventive liquid crystal panel.

DETAILED DESCRIPTION OF THE PREFERRED EMBODIMENTS

Figure 1:
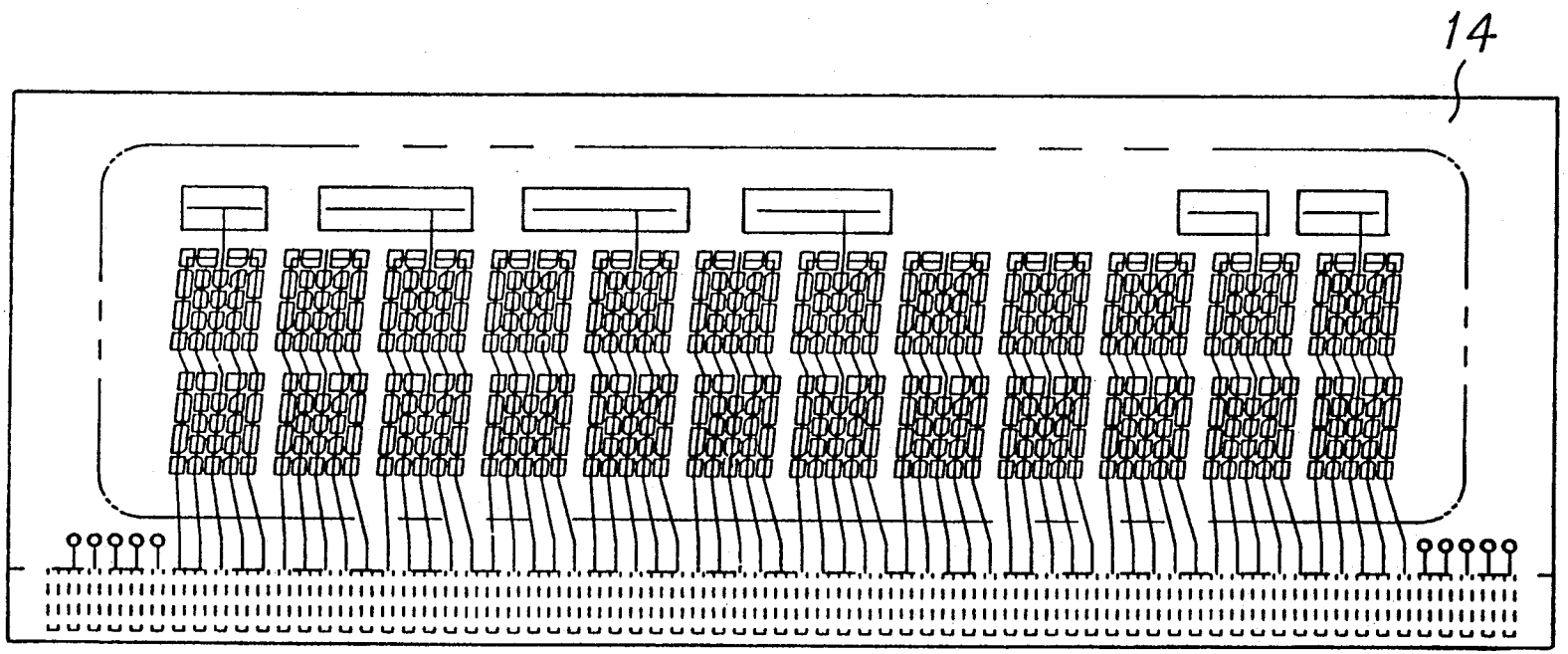
FIG. 1 is a wiring diagram showing segments arranged on an upper panel of a liquid crystal panel disclosed in the first embodiment of the present invention.

Referring to the drawings, there is shown a preferred embodiment of the present invention.

The inventive liquid crystal panel is characterized by that there is arranged one or more groups of display segments. Each group is, as shown in FIG. 3, composed of twenty-two segments: —four segments located in four corners of a rough quadrilateral, "a," "d," "r," and "v"; two segments in an oblong shape located on a left side area of the quadrilateral, "e" and "m"; two segments in an oblong shape located on a right side area of the quadrilateral, "i" and "q"; three segments located on a lower side area of the quadrilateral "s," "t" and "u"; nine segments in three columns in three rows located inside of the quadrilateral outlined by above eleven segments, "f," "g," "h," "j," "k," "l," "n," "o" and "p"; and two segments located on an upper area of the quadrilateral and having a width larger than those of the nine above segments inside the quadrilateral, "b" and "c."

Figure 3:
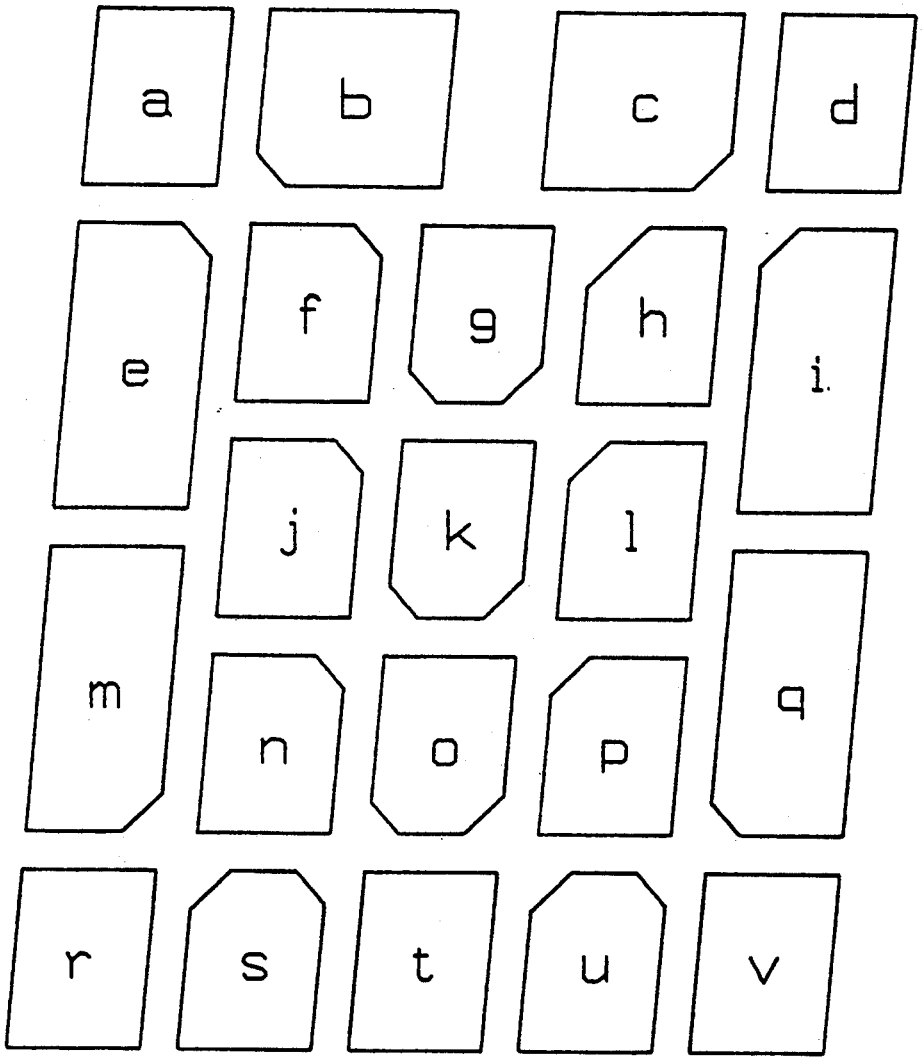
FIG. 3 is an enlarged view of the segments of the inventive liquid crystal panel.
Figure 15:
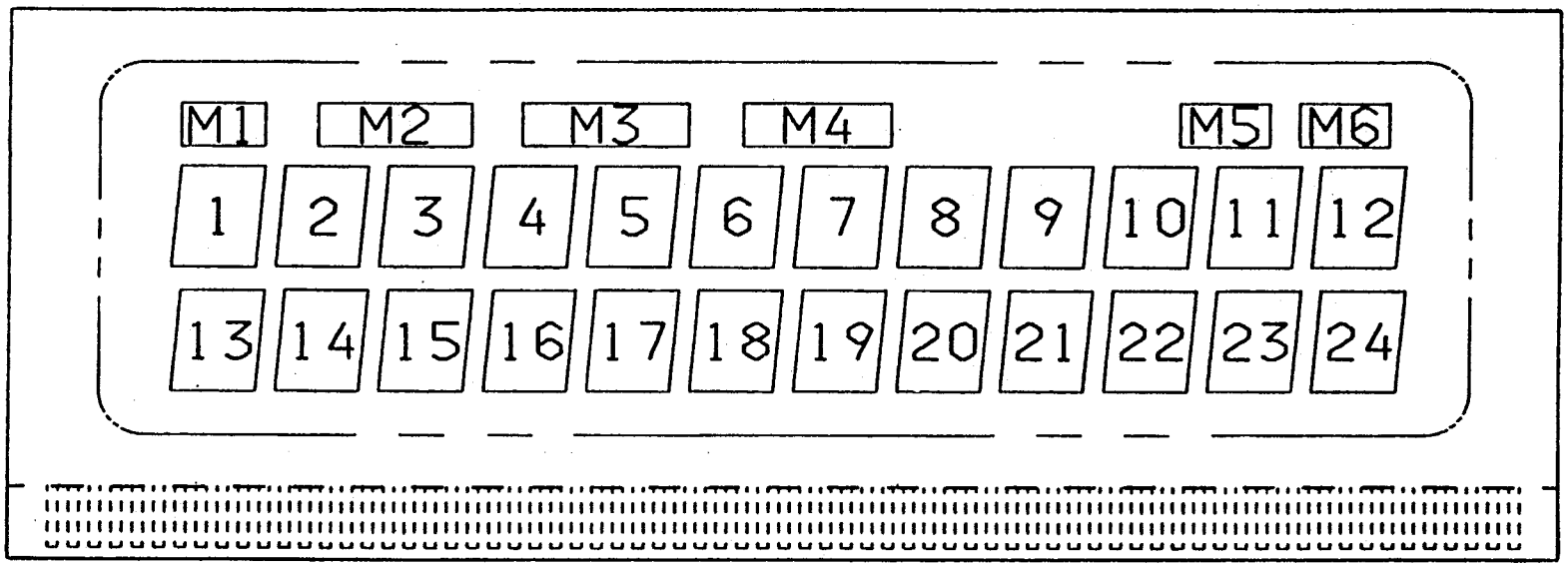
FIG. 15 is a diagram showing numbers which indicate positions of respective characters of the inventive liquid crystal panel.

In FIG. 15, for instance, "12*c*" is found at an intersection of a row of a segment electrode SEC1 and a column of a common electrode COM1 in FIG. 7, which means that "c" shown in FIG. 3 is turned on among the segments arranged in a position 12 of the panel shown in FIG. 15.

Figure 2:
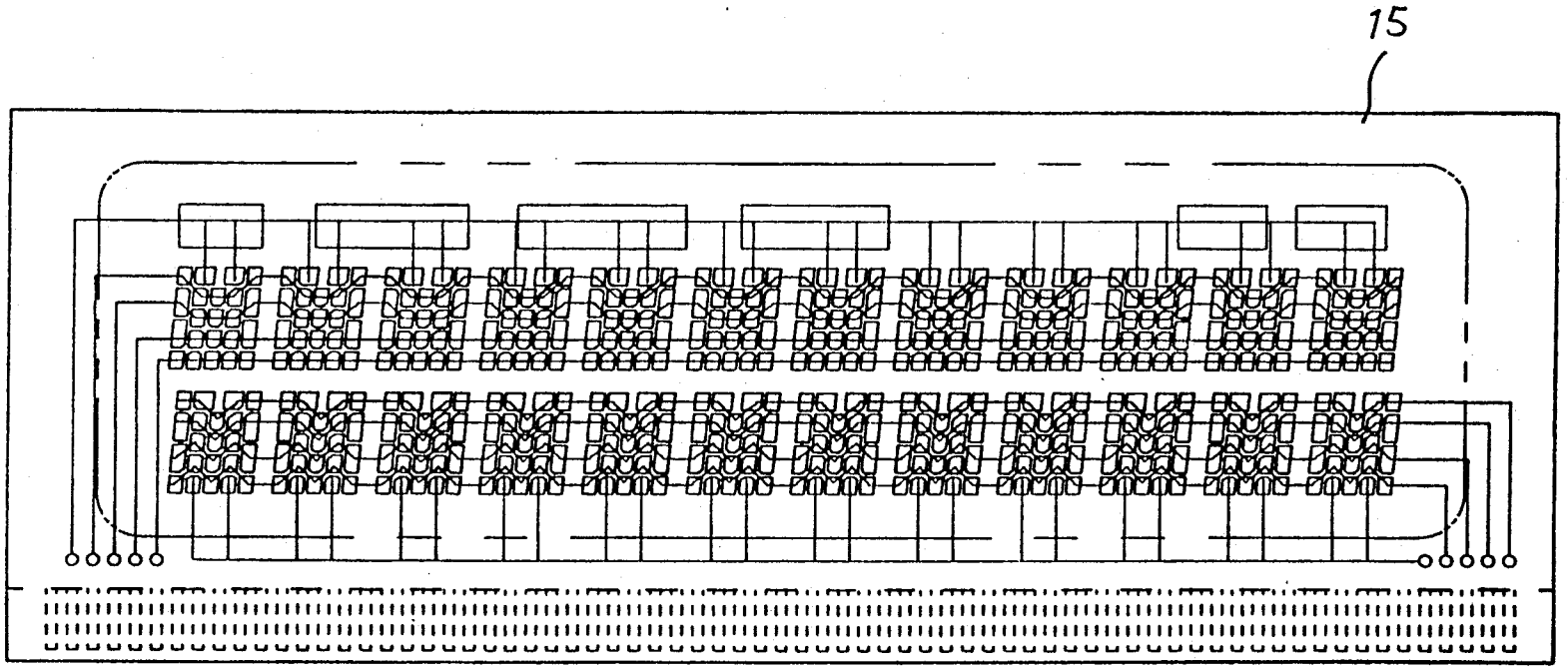
FIG. 2 is a wiring diagram showing the segments arranged on a lower panel of the inventive liquid crystal panel.

Referring to the assignment tables of FIGS. 7 to 10, there is explained operation that alphanumeric characters are displayed on the liquid crystal panel shown by FIGS. 1 to 3.

The following is an explanation on a case that a character "A" is displayed on a left corner of an upper row of the liquid crystal panel 20. As shown on an upper left corner of FIG. 4, a character "A" is displayed by turning on segments "b," "c," "e," "i," "j," "k," "l," "m," "q," "r," and "v" in the enlarged view of FIG. 3. In other words, the character "A" is displayed on the left corner of the upper row of the liquid crystal panel 20 by giving driving signals, at respective predetermined timing, to segment electrodes; S56, S57, S58, S59 and S60 and to common electrodes: COM1, COM6, COM7, COM8 and COM9 so that segments 1b, 1c, 1e, 1i, 1j, 1k, 1l, 1m, 1q, 1r and 1v (the first character of each sign stands for a numeral "one" and the second is an alphabetical letter) in the assignment table of FIG. 10 should be turned on.

Figure 4:
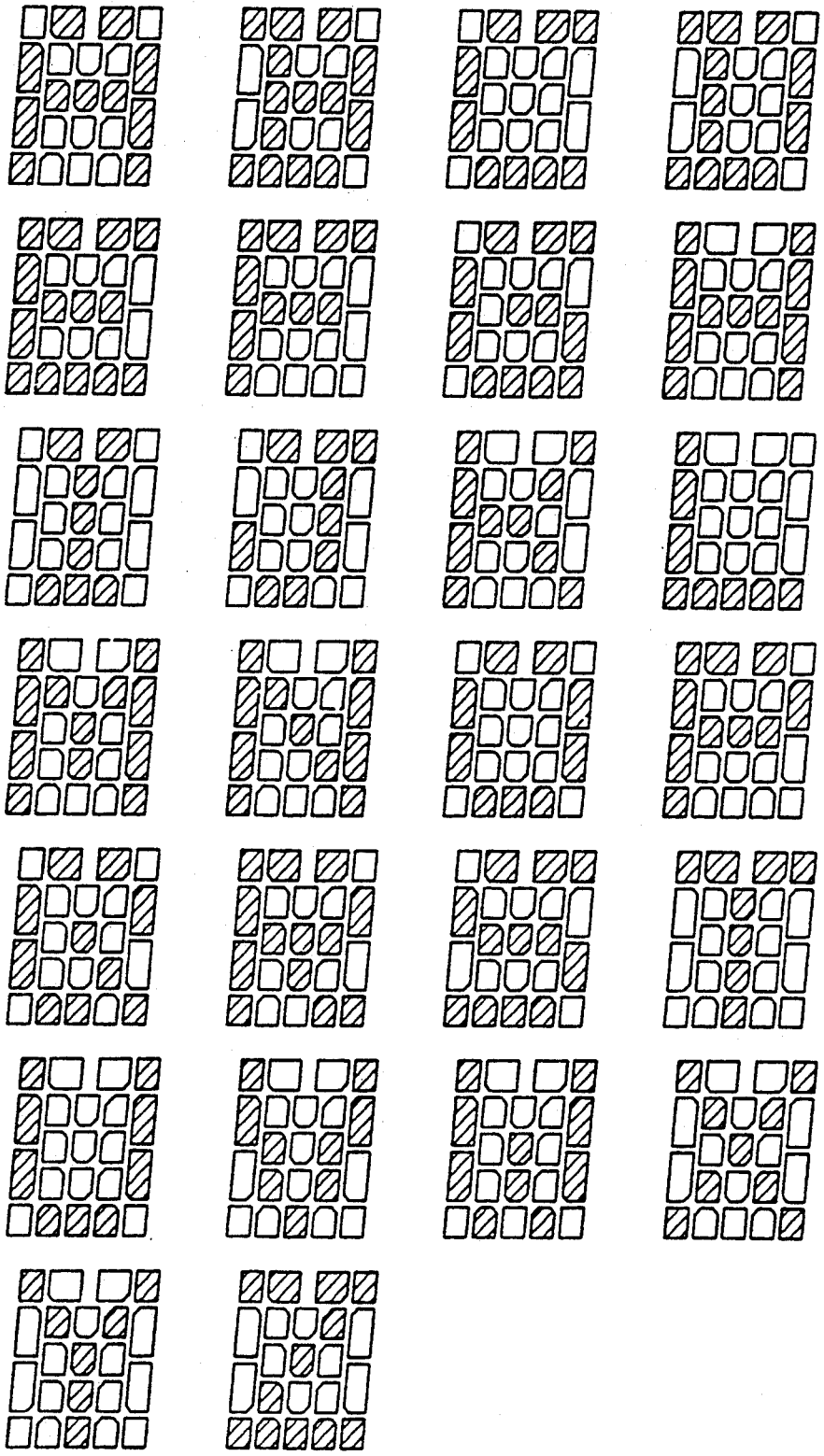
FIG. 4 is a display configuration diagram showing the alphabetic letters displayed by the inventive liquid crystal panel.
Figure 5:
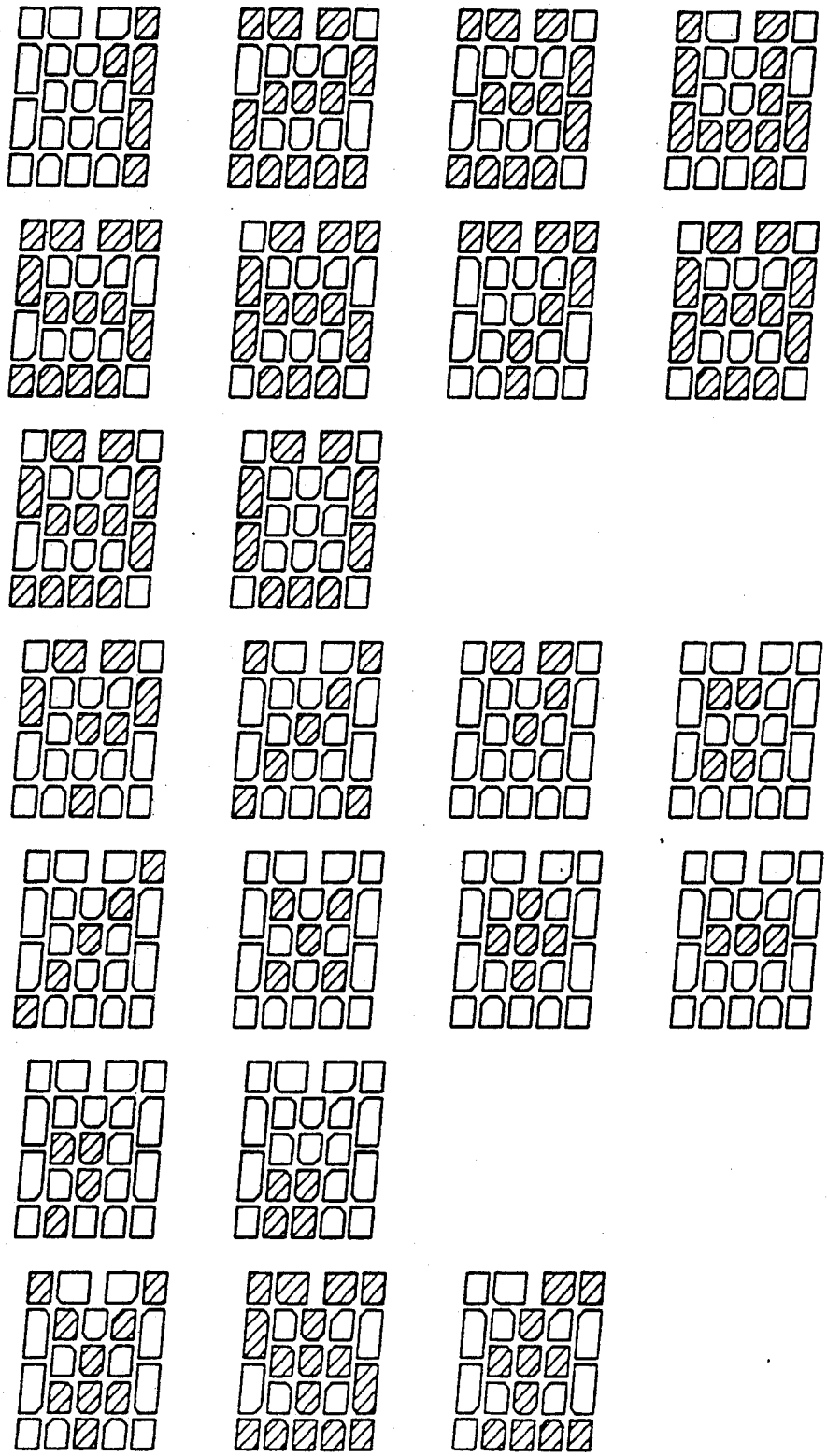
FIG. 5 is a display configuration diagram showing the numerals and symbols displayed by the inventive liquid crystal panel.

Similarly, other alphabetical letters can be displayed by turning on the segments shown in FIG. 4, and numerals and symbols can be displayed by turning on the segments shown in FIG. 5.

Conventionally, when alphanumeric characters are displayed with these nine common electrodes and sixty segment electrodes, a capacity display is one line of twelve alphanumeric characters displayed on the first row and only twelve figures displayed on the second row by dot matrices.

However, it is possible to display two lines of twelve alphanumeric characters in the configuration shown in FIGS. 4 and 5 only with the nine common electrodes and the sixty segment electrodes by assigning, as the assignment tables of FIGS. 7 to 10 indicate, an upper panel (segment electrodes) and a lower panel (common electrodes) of the inventive liquid crystal panel which has the segments arranged as shown in FIGS. 1 to 3.

Next, referring to the drawings, there is shown an embodiment of the inventive display device.

Figure 6:
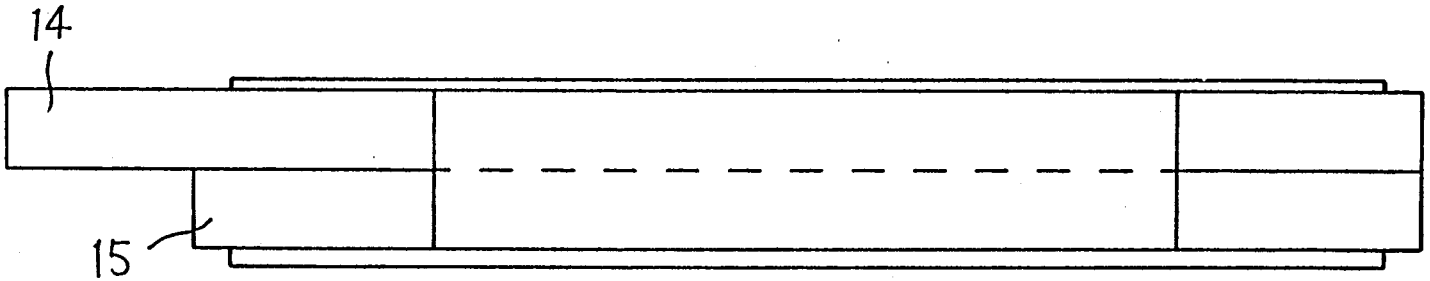
FIG. 6 is a sectional view showing the structure of the inventive liquid crystal panel.

In FIG. 6, the segment electrodes shown in FIG. 1 are formed on the upper panel 14 composing the liquid crystal panel 20, and the common electrodes shown in FIG. 2 are formed on the lower panel 15 composing the liquid crystal panel 20.

Figure 11:
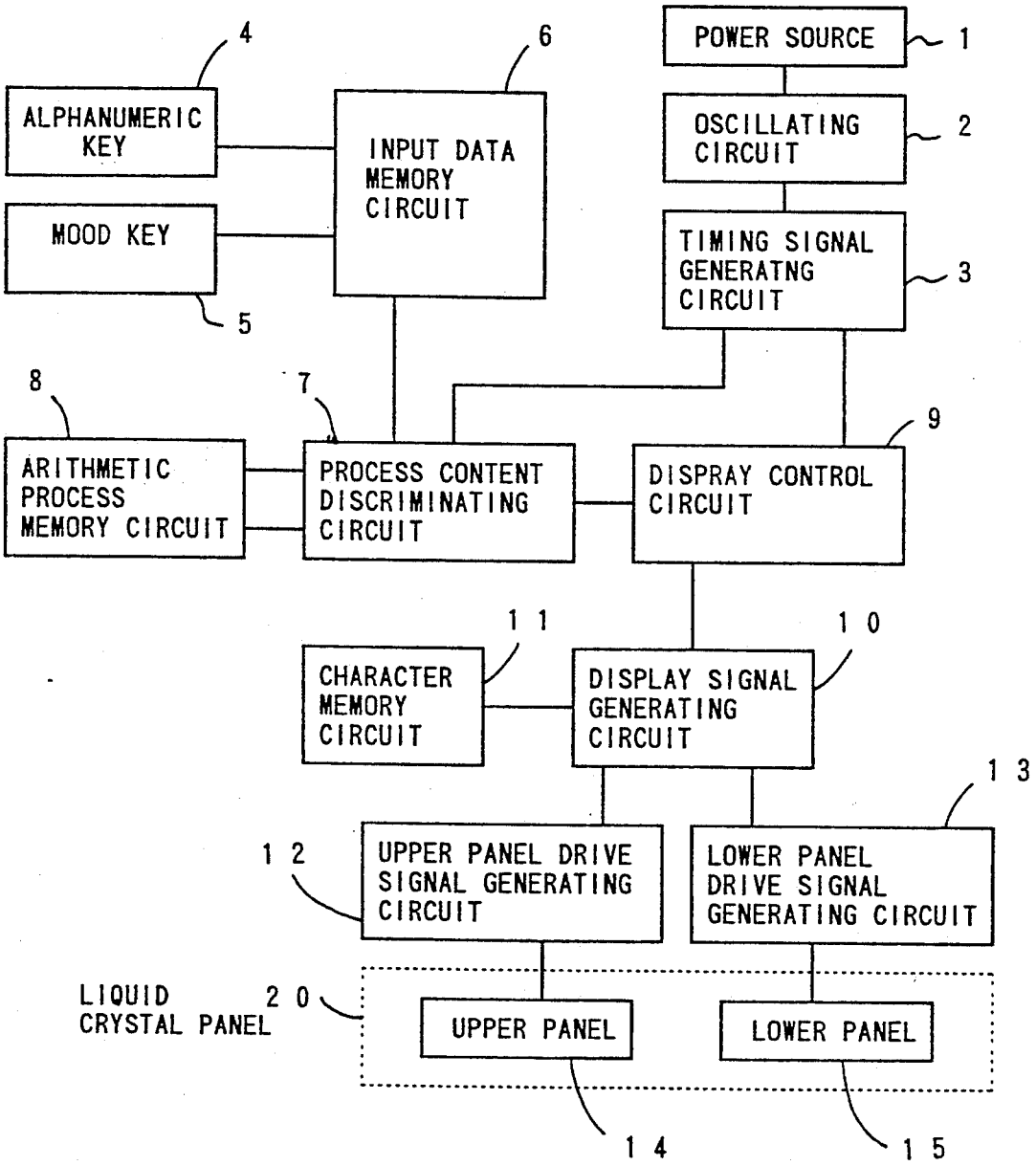
FIG. 11 is a system block diagram showing the embodiment of the inventive display device.

In FIG. 11, an oscillating circuit 2 generates a basic clock, and a timing signal generating circuit 3 generates timing signals according to the basic clock. A data such as alphanumeric characters is inputted with the alphanumeric keys 4, and operation of the device is instructed with the mode keys 5. The data inputted by the alphanumeric keys 4 or instructed by the mode keys 5 is memorized in an input data memory circuit 6.

Figure 12:
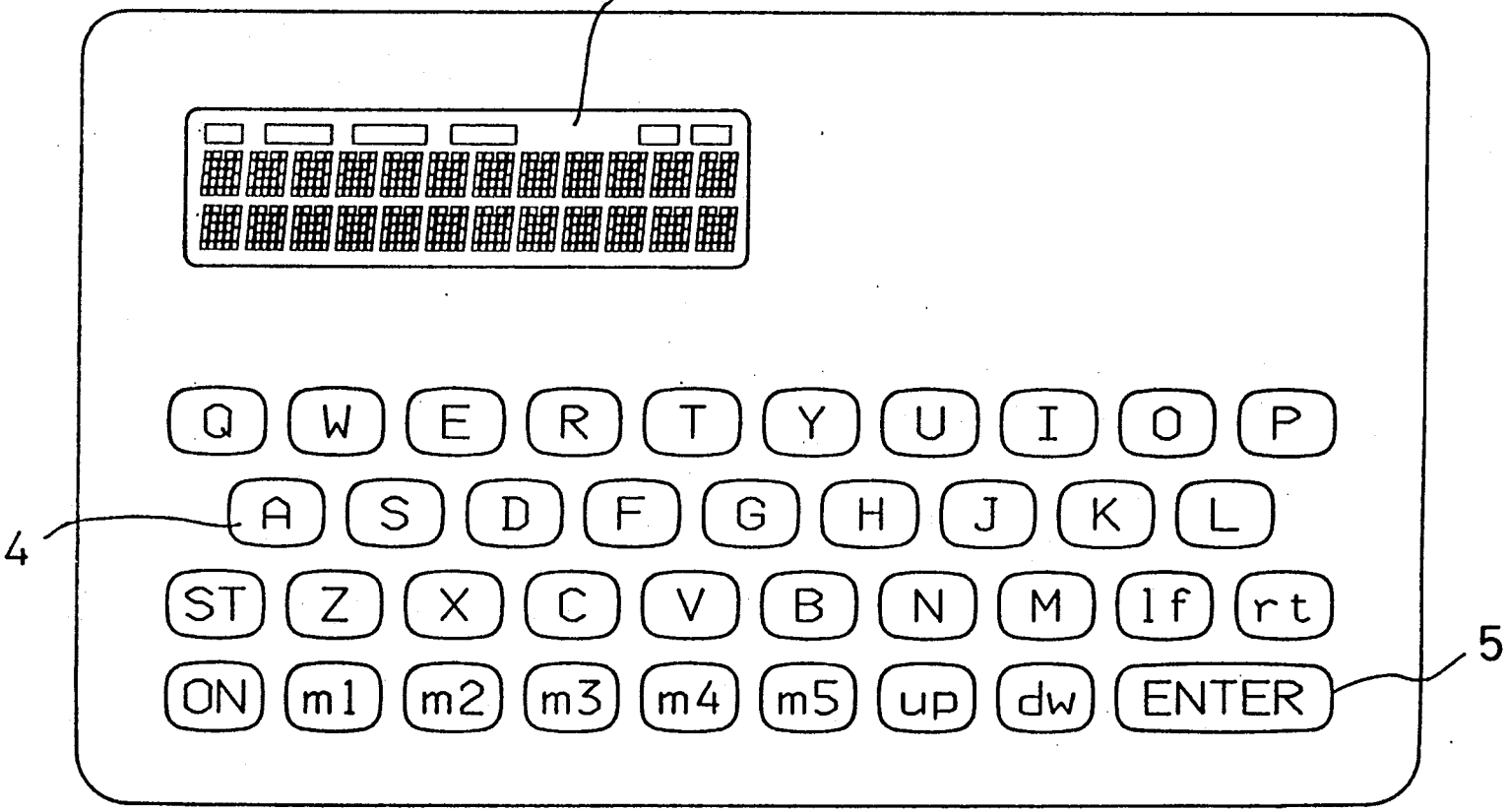
FIG. 12 is an external appearance view showing the embodiment of the inventive display device.

In FIG. 12, the inventive liquid crystal panel 20 is arranged in the upper part of the display device. In the lower part of the display device, there are provided alphanumeric keys 4 for inputted data and mode keys for giving operation instructions to the device.

Then, the inputted character data and the operation instruction whether to memorize the inputted character data or to search for another data memorized in an arithmetic process memory circuit 8 which are inputted to the input data memory circuit 6, are sent to a process content discriminating circuit 7. The process content discriminating circuit 7, by using the timing signals sent from the timing signal generating circuit 3, executes a predetermined operation and determines a character data to be displayed according to the inputted character data and operation instruction, and current status. In this process, the process content discriminating circuit 7 writes the data to be memorized into the arithmetic process memory circuit 8 and reads out the data to be searched for from the arithmetic process memory circuit 8.

Then, the process content discriminating circuit 7 sends the determined character data to be displayed, to a display control circuit 9. The display control circuit 9 sends the character data to be displayed, together with a predetermined display timing, to a display signal generating circuit 10. According to the display timing, the display signal generating circuit 10 converts the data to be displayed into an actuating signal with a character memory circuit 11. The converted actuating signal is sent from the display signal generating circuit 10 to an upper panel drive signal generating circuit 12, and a common timing signal is sent to a lower-panel drive signal generating circuit 13. The upper drive signal generating circuit 2 and the lower drive signal generating circuit 13 convert the received actuating signals into driving waveforms of voltage level enough to drive the liquid crystal panel 20 respectively, and give each of the driving waveforms to the upper panel 14 and the lower panel 15 respectively; and thereby alphanumeric characters are displayed on the liquid crystal panel 20.

Figure 13:
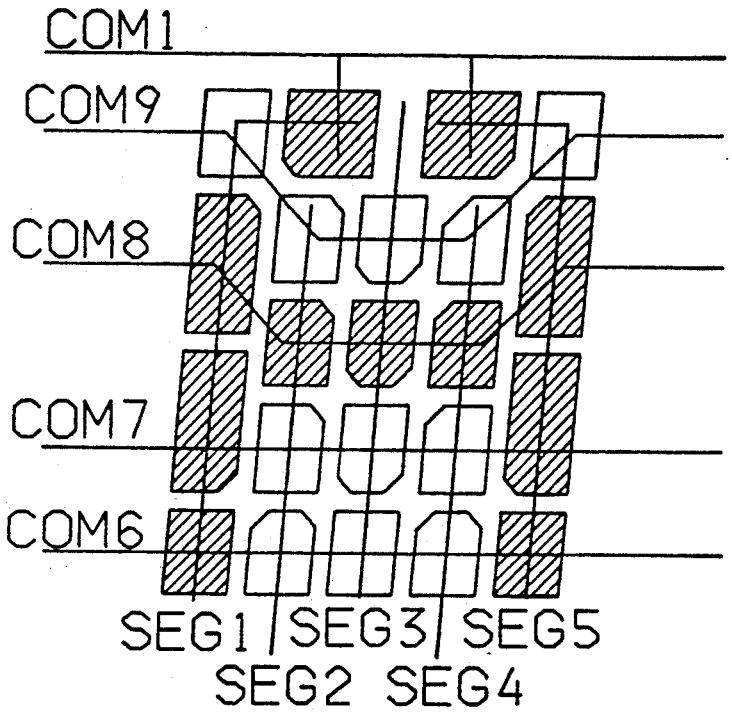
FIG. 13 is a diagram showing a part of character configuration data, memorized in the inventive character memory circuit, which displays a predetermined character data by actuating predetermined segments among the twenty two segments of the inventive liquid crystal panel.
Figure 14:
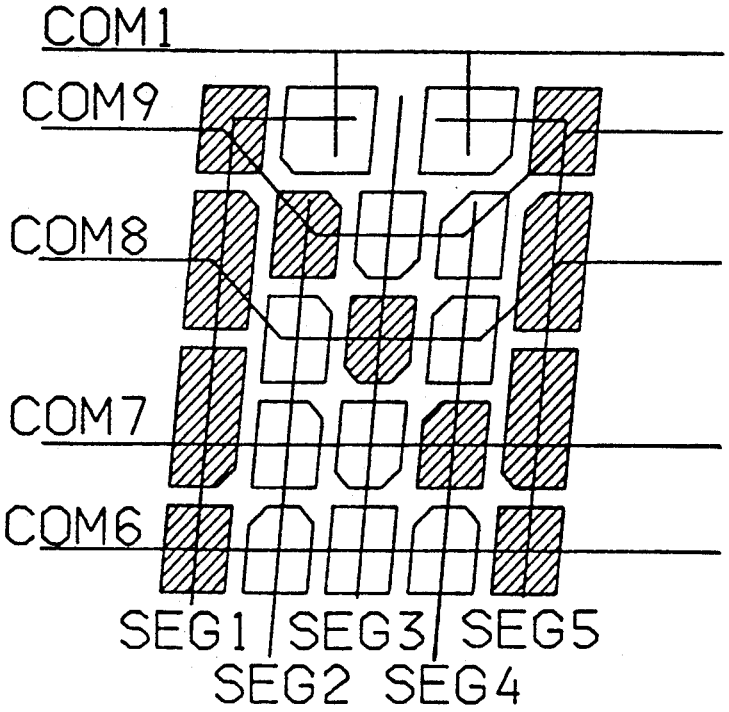
FIG. 14 is a diagram showing a part of character configuration data, memorized in the inventive character memory circuit, which displays a predetermined character data by actuating predetermined segments among the twenty-two segments of the inventive liquid crystal panel.

In FIGS. 13 and 14, in this device, one character is displayed with five segments. For instance, if the character data of a character "A" is "41" in hexadecimal, according to the character data "41" the character memory circuit 11 memorizes the data: give a turn-on signal to each of the common electrodes COM6, COM7 and COM8 above the first segment electrode SEG1 arranged on the first line from the lift side; give a turn on signal to each of the common electrodes COM1 and COM8 above the second segment electrode SEG2; give a turn-on signal to the common electrode COM8 above the third segment electrode SEG3; give a turn-on signal to each of the common electrodes COM1 and COM8 above the fourth electrode SEG4; and a give turn-on signal to each of the common electrodes COM6, COM7 and COM8 above the fifth segment.

Because in the inventive liquid crystal panel, the first line and the second line of common wiring are not symmetrical, the character memory circuit 11 also memorizes the character configuration for the second line apart from the character configuration for the first line.

Referring to the FIGS. 13 and 14, there is shown operation of the display device disclosed by the embodiment of the invention. When a data "SUZUKI" is inputted by the alphanumeric keys 4 and an instruction "ENTER(execute)" is given by the mode key 5 if a current state is an input state, the process content discriminating circuit 7 determines that the character data "SUZUKI" would be memorized in the arithmetic process memory circuit 8 and that a message for requiring the next data would be displayed, and sends the character data "NUMBER? " to the display control circuit 9.

The display control circuit 9 uses the character memory circuit 11 to convert each letter of the character data "NUMBER?" into an actuating signal in the order of spelling, that is, beginning with the first letter "N." Since the letter "N" is in the first position from the left hand in the word "number", the "N" is displayed in the segments 56 to 60 shown in the assignment table of FIG. 10. At this time, the display control circuit 9 converts the character data "N" into actuating signals so that a turn-on signal might be given to each of the common electrodes COM6, COM7, COM8 and COM9 above the first segment electrode SEG1 arranged on the first line from the left side; a turn-on signal might the given to the common electrode COM9 above the second segment electrode SEG2; a turn-on signal might be given to the common electrode COM8 above the third segment electrode SEG3; a turn-on signal might be given to the common electrode COM7 above the fourth segment electrode SEG4; and a turn-on signal might be given to each of the common electrodes COM6, COM7, COM8 and COM9 above the fifth segment electrode SEG5.

In a similar way, each of the characters "U," "M," "B," "E," "R," and "?" are converted into actuating signals respectively by the character memory circuit 11 so that "U" might be displayed in the segments 51 to 55 shown in the assignment table of FIG. 10; "M" might be displayed in the segments 46 to 50 shown in the same table; "B" might be displayed in the segments 41 to 43 shown in the assignment table of FIG. 9 and in the segments 44 to 45 shown in the assignment table of FIG. 10; "E" might be displayed in the segments 36 to 40 shown in the assignment table of FIG. 9; "R" might be displayed in the segments 31 to 35 shown in the same table; and "?" might be displayed in the segment 26 shown in the assignment table 8 and in the segments 27 to 30 shown in the assignment table of FIG. 9.

The converted actuating signals are sent to the upper panel drive signal generating circuit 12, and the common timing signals are sent to the lower panel drive signal generating circuit 13. The upper and lower drive signal generating circuits 12 and 13 convert the respective received actuating signals into drive wave forms of voltage level enough to drive the liquid crystal panel 20, and send the wave forms to the upper panel 14 and the lower panel 15 respectively, and thereby the alphabetic letters and a symbol "NUMBER?" are displayed on the liquid crystal panel 20.

Figure 16:
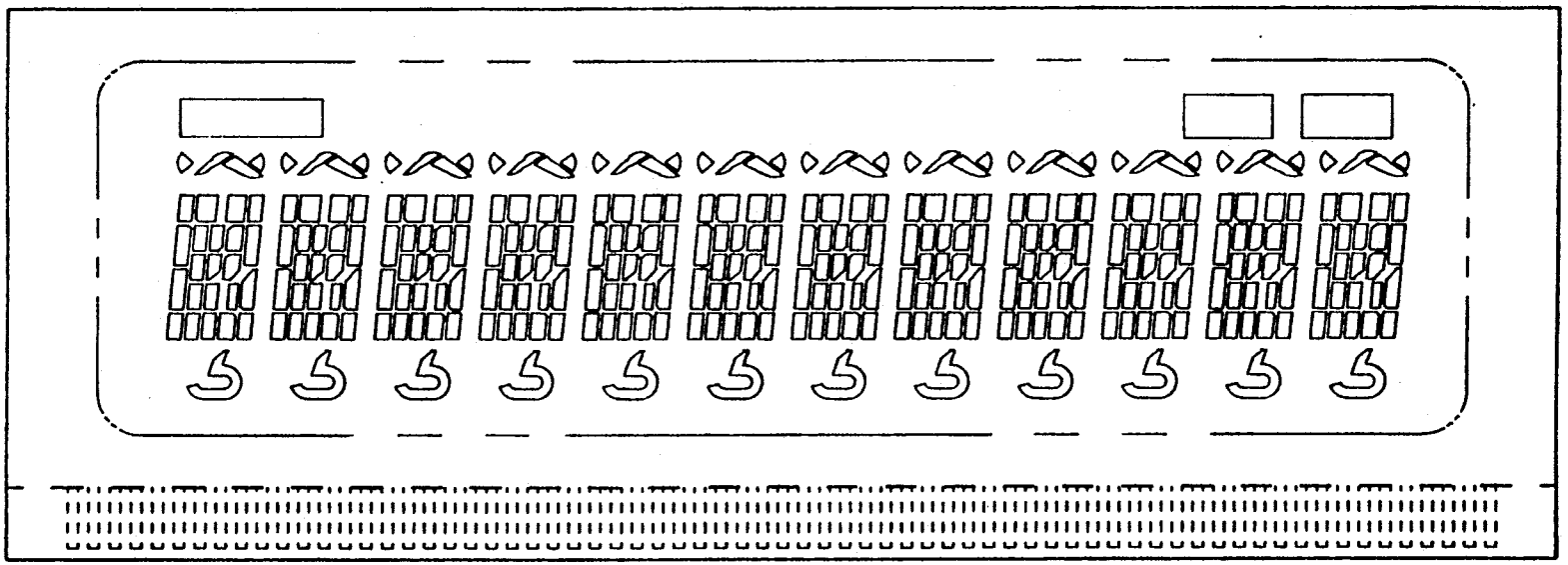
FIG. 16 is a top view of the liquid crystal panel disclosed by the second embodiment of the present invention.

The second embodiment of the inventive liquid crystal panel shown in FIG. 16 is different from the first embodiment of the present invention shown in FIG. 1 in that a display unit includes twenty-two segments, two dots arranged over the twenty-two segments, an oblong segment falling leftwards arranged on the left side of a space between the two dots; an oblong segment falling rightwards arranged on the right side of a space between the two dots; and moreover a hook-like-shaped segment arranged under the twenty-two segments.

Such arrangement of the segments enables an umlaut in German and an accent and a cedilla in French to be displayed.

When the inventive display device is used as a telephone directory with an address book, a name, an address and a telephone number are inputted by the alphanumeric keys 4 and memorized in the arithmetic process memory circuit 8. A reference mode is set by the mode key 5, and the name of a person is inputted by the alphanumeric keys 4. Then, the address and the phone number of that personal are displayed on the liquid crystal panel 20.

The inventive device can be also used as a data bank and a functional calculator if various data and functional equations are memorized in the arithmetic process memory circuit 8 beforehand.

In the above embodiment there is shown the liquid crystal panel; as shown in FIGS. 4 and 5, it is also possible to use an LED (light-emitting diode), a neon tubes, a roll bar and so on for display with twenty-two segments.

The present invention has the following effects. (1) On the inventive panel, it is possible to display legibly characters and symbols with twenty-two segments, thirteen segments less than the number of segments used for displaying with dot matrices (5×7); therefore the present invention can provided a liquid crystal panel which can legibly display alphanumeric characters with fewer segments than the conventional ways. (2) Conventionally when alphanumeric characters are displayed with the nine common electrodes and sixty segment electrodes, the utmost that the panel can display at once is one line of twelve alphanumeric characters displayed by dot matrices on the first line and a number only in twelve figures displayed on the second line. However, the inventive liquid crystal panel can display two lines of twelve alphanumeric characters at once.

What is claimed is:

1. A liquid crystal panel comprising groups of twenty-two display segments, each of the group including:

four segments located in four corners of a rough quadrilateral;

two segments in an oblong shape located on a left side area of the quadrilateral;

two segments in an oblong shape located on a right side area of the quadrilateral;

three segments located on a lower side area of the quadrilateral;

nine segments in three columns in three rows located inside of the quadrilateral outlined by the above eleven segments, and two segments located on an upper side area of the quadrilateral and having a width larger than those of said nine segments inside the quadrilateral.

2. A display device comprising:

a power source;

an oscillating circuit generating a basic clock;

a timing signal generating circuit for generating a predetermined timing signal from the basic clock;

alphanumeric keys for inputting a data;

mode keys for instructing an operation of the device;

an input data memory circuit for memorizing the data inputted and instructed by the alphanumeric keys and the mode keys;

a process content discriminating circuit for discriminating a predetermined process from the data sent from the input data memory circuit and the timing signal sent from the timing signal generating circuit, and for outputting an execution instruction;

an arithmetic process memory circuit for memorizing the data and sending a read-out data to the process content discriminating circuit according to the execution instruction from the process content discriminating circuit;

a display control circuit for receiving a data to be displayed from the process content discriminating circuit, and for sending out the data to be displayed with a predetermined display timing according to the execution instruction from the process content discriminating circuit;

a character memory circuit for memorizing a character configuration indicating a predetermined character data by actuating predetermined segments among twenty-two segments of a liquid crystal panel;

a display signal generating circuit for receiving the display timing and the data to be displayed from the display control circuit and for converting the data to be displayed into an actuating signal with the character memory circuit according to the display timing;

a first drive signal generating circuit for receiving the actuating signal from the display signal generating circuit and forming a signal for driving a first panel of a liquid crystal panel in order to display the predetermined character data;

a second drive signal generating circuit for receiving the actuating signal from the display signal generating circuit and forming a signal for driving a second panel of the liquid crystal panel in order to display the predetermined character data; and a liquid crystal panel for displaying the predetermined character data by the signal for driving the first panel and the signal for driving the second panel, the liquid crystal panel having groups of twenty-two display segments including four segments located in four corners of a rough quadrilateral, two segments in an oblong shape located on a left side area of the quadrilateral, two segments in an oblong shape located on a right side area of the quadrilateral, three segments located on a lower side area of the quadrilateral, nine segments in three columns in three rows located inside of the quadrilateral outlined by the above eleven segments, and two segments located on an upper side area of the quadrilateral and having a width larger than those of said nine segments inside the quadrilateral.

3. A method for displaying a character data comprising the steps of:

arranging groups of twenty two display segments as display units respectively, each of the groups including:

four display elements located in four corners of a rough quadrilateral, two display elements in an oblong shape located on a left side area of the quadrilateral, two display elements in an oblong shape located on a right side area of the quadrilateral, three display elements located on a lower side area of the quadrilateral, nine display elements in three columns in three rows located inside of the quadrilateral outlined by the above eleven display elements, and two display elements located on an upper side area of the quadrilateral and having a width larger than those of said nine elements inside the quadrilateral; and actuating the twenty-two display elements by an output signal from a character memory circuit for memorizing a character configuration indicating a predetermined character data.

4. A liquid crystal panel as claimed in claim 1 further comprising at least two dots arranged over the twenty-two segments for displaying an umlaut in German.

5. A liquid crystal panel as claimed in claim 1 further comprising:

at least an oblong segment arranged over the twenty-two segments for displaying an accent in French; and a hook-like-shaped segment arranged under the twenty two segments for displaying a cedilla in French.

* * * * *